United States Patent [19]

Allen

[11] 4,062,194

[45] Dec. 13, 1977

[54] MINE ROOF SUPPORTS

[75] Inventor: Archelaius Dawson Allen, Leyland, England

[73] Assignee: Gullick Dobson Limited, Wigan, England

[21] Appl. No.: 657,936

[22] Filed: Feb. 13, 1976

[30] Foreign Application Priority Data

Apr. 4, 1975 United Kingdom ..... 13812/75

[51] Int. Cl.[2] ..... E21D 15/44

[52] U.S. Cl. ..... 61/45 D

[58] Field of Search ..... 61/45 D; 299/31-33; 248/357; 91/170 MP

[56] References Cited

U.S. PATENT DOCUMENTS

| | | | |
|---|---|---|---|
| 3,408,820 | 11/1968 | Bower | 61/45 D |
| 3,425,229 | 2/1969 | Groetschel | 61/45 D |
| 3,570,255 | 3/1971 | Shuttleworth | 61/45 D |

FOREIGN PATENT DOCUMENTS

| | | | |
|---|---|---|---|
| 2,040,539 | 2/1972 | Germany | 61/45 D |

*Primary Examiner*—Dennis L. Taylor

*Attorney, Agent, or Firm*—Berman, Aisenberg & Platt

[57] ABSTRACT

A roof-engaging assembly for a mine roof support having prop or jack means to engage and support the roof-engaging assembly, comprises a rigid part to engage said prop or jack means, and a roof-engaging part positioned over and resiliently urged away from the rigid part. Preferably the rigid part has a roof-engaging face and a relatively stepped or recessed face below the roof-engaging face, the roof-engaging part being positioned over and resiliently urged away from the stepped or recessed face and towards positions above the roof-engaging face of the rigid part.

7 Claims, 3 Drawing Figures

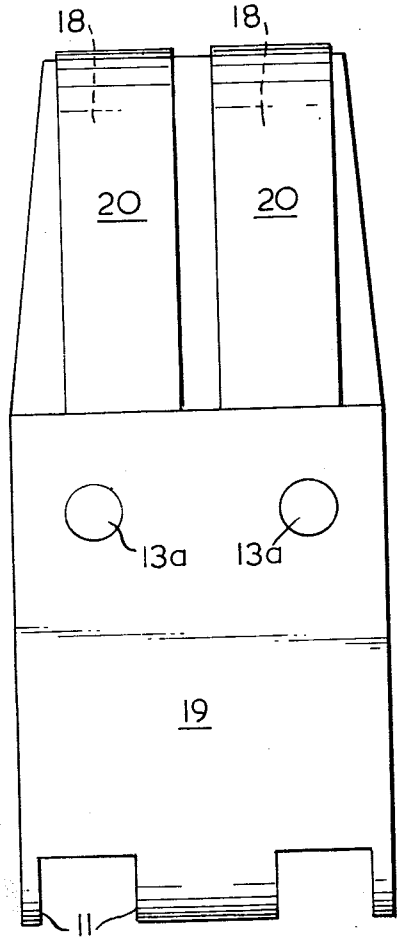
-FIG. 2-
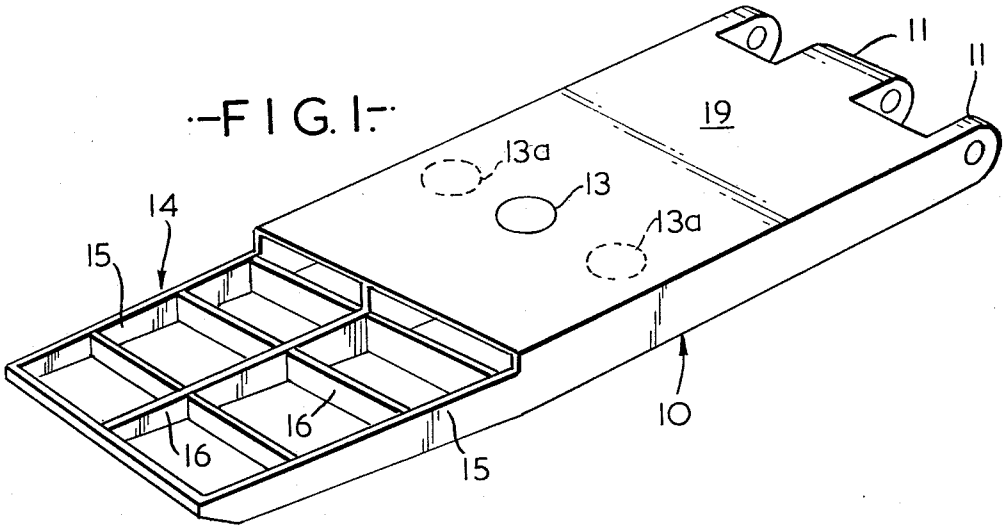
-FIG. 1-
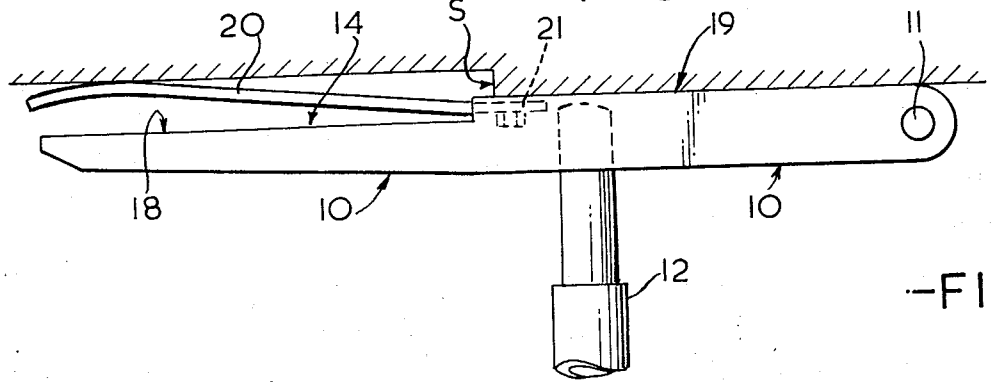
-FIG. 3-

MINE ROOF SUPPORTS

BACKGROUND OF THE INVENTION

This invention is for an improved mine roof support and is particularly although not exclusively applicable to a mine roof support having hydraulically extensible prop or jack means for applying a roof-engaging member or canopy to and holding it against the roof to be supported. Such a support is frequently made self-advancing in which case it may also incorporate pressure-fluid ram means connected between the support and a mineral face conveyor. After having advanced the conveyor, towards the mineral face being worked, the ram means is operated, using the conveyor as an anchorage, to advance the roof support, the prop means having temporarily been released from between floor and roof. Alternatively the ram means may be connected between two similar roof supporting units of the support, each unit serving in turn as an abutment or anchorage for the advance of other when the latter has been temporarily released from between floor and roof.

SUMMARY OF THE INVENTION

According to the present invention there is provided a mine roof support comprising prop or jack means and a roof-engaging assembly supported on or by said prop or jack means, said roof-engaging assembly having a rigid part and a roof-engaging part positioned over and resiliently urged away from said rigid part.

According to a further feature of the invention there is provided a roof-engaging assembly for a mine roof support having prop or jack means to engage and support the roof-engaging assembly, comprising a rigid part to engage said prop or jack means, and a roof-engaging part positioned over and resiliently urged away from the rigid part.

With the known form of roof-engaging member or canopy, if there is a step or the like in the roof to be supported a part only of said member or canopy can bear against the roof, i.e. the roof will be engaged only on one side of the step. With an arrangement embodying the present invention the roof will be supported on one side of the step by the rigid part of the roof-engaging assembly and on the other side, at least to a material extent, by the resilient roof-engaging part which will have been urged away from the abutment or recess face and will be sufficiently "stiff" to afford such support.

Preferably the design is such that when the roof is level the resiliently urged roof-engaging part will contact the stepped or recessed abutment face of the rigid part when the roof-engaging surfaces of both parts are at substantially similar levels.

The resilient roof-engaging part may be inherently resilient (e.g. it may be in the form of a spring steel bar or plate) or it may comprise a rigid roof-engaging element resiliently mounted, by spring means, on the rigid part of the roof-engaging assembly.

Preferably the rigid part of the roof-engaging assembly is of open-work or lattice-like construction so that debris will fall through it and not interfere with the required downward movement of deflection of the resilient roof-engaging part.

BRIEF DESCRIPTION OF THE DRAWINGS

One particular embodiment of the invention will now be described, by way of example, with reference to the accompanying semi-diagrammatic drawings. In the drawings:

FIG. 1 is a perspective view of the forward roof-engaging member of the roof-engaging structure of a self-advancing mine roof support.

FIG. 2 is a plan view of the roof member shown in FIG. 1, and

FIG. 3 is a side elevation of the roof member shown in FIG. 1.

DESCRIPTION OF THE PREFERRED EMBODIMENT

The roof-engaging member shown on the drawing comprises a rigid part 10 adapted to be hingedly connected to the front of a roof-engaging canopy of the support in the usual way. For that purpose it is provided at its rear end with hinging elements 11.

The part 10 is supported by hydraulically extensible prop means 12 mounted in the base of the support. There may, for example, be one such prop positioned as indicated at 13 in FIG. 1 or two such props positioned as indicated at 13*a* in FIG. 1.

The forward portion of the part 10 is recessed as indicated at 14 and is of open-work construction comprising a frame 15 and ribs 16. The upper surfaces of the frame 15 and ribs 16 provide an abutment or recess face 18 which lies below the roof-engaging face 19 of the part 10.

The roof-engaging member also comprises two spring steel bars or leaf springs 20 (not shown in FIG. 1) secured to the part 10, as indicated at 21, and positioned over the abutment or recess face 18 of the part 10. The bars 20 are bowed to a small extent particularly at their forward ends so that they will not dig into the roof and interfere with the advance of the support.

The spring steel bars 20 are set, say 3 inches, above the horiontal i.e. above the face 19 of the part 10.

Referring to FIG. 3 it will be noted that there is a step S in the roof and said roof is being supported on one side of the step by the rigid part 10 and on the other side of the step by the spring steel bars 20.

In the absence of a step, i.e. with a level roof, the bars 20 will be forced down into the recess 14 so that their upper faces are flush with the face 19 of the rigid part of the roof-engaging member. In this condition the bars 20 or a part thereof may bear against the abutment face 18 so that, in effect the whole roof-engaging member becomes a substantially rigid unit. In any case the face 18 will prevent the spring steel bars being forced beyond the horizontal and permanently bent out of their predetermined form.

It will also be seen that the effect of the crushing of the step 'S', due to the increasing load or convergence, is that the forward portions of the bars 20 gradually accept the load so that as the step 'S' decreases the resistance of the bars 20 increases until they become substantially rigid.

I claim:

1. A roof-engaging assembly for a mine roof support having prop or jack means to engage and support the roof-engaging assembly, comprising a rigid part to engage said prop or jack means, the rigid part having a roof-engaging face and a relatively stepped or recessed face below the roof-engaging face, a roof-engaging part positioned over said stepped or recessed face and resiliently urged away therefrom towards positions above the roof-engaging face of the rigid part which, at least where it underlies the resiliently urged roof-engaging part, is of open-work or lattice-like construction to allow passage through of foreign matter.

2. An assembly according to claim 1, wherein the roof-engaging part is so formed that it contacts the stepped or recessed face when the roof-engaging surfaces of both parts are at substantially similar levels.

3. An assembly according to claim 1, wherein the roof-engaging part comprises one or more resiliently urged members.

4. An assembly according to claim 3, wherein the or each said member is inherently resilient.

5. An assembly according to claim 4, wherein the or each said member comprises a spring steel bar fixed at one end to the rigid part.

6. An assembly according to claim 4, wherein the or each said member comprises a leaf-spring fixed at one end to the rigid part.

7. An assembly according to claim 3, wherein the or each said member curves downwardly over a portion thereof to facilitate movement of the assembly and its support.

* * * * *